US012703548B2

(12) United States Patent
Morciano et al.

(10) Patent No.: US 12,703,548 B2
(45) Date of Patent: Aug. 11, 2026

(54) SPOUT FOR A PACKAGE, LID-SPOUT ASSEMBLY FOR A PACKAGE AND PACKAGE HAVING A SPOUT

(71) Applicant: TETRA LAVAL HOLDINGS & FINANCE S.A., Pully (CH)

(72) Inventors: Davide Morciano, Modena (IT); Pietro Martini, Parma (IT); Rocco De Paola, Modena (IT); Paolo Zanon, Modena (IT); Ivan Orlandi, Savignano sul Panaro (IT); Anna Rosa Vietri, Modena (IT); Cristian Costarelli, Ancona (IT); Davide Corradi, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 173 days.

(21) Appl. No.: 17/914,059

(22) PCT Filed: Apr. 1, 2021

(86) PCT No.: PCT/EP2021/058618
§ 371 (c)(1),
(2) Date: Sep. 23, 2022

(87) PCT Pub. No.: WO2021/204670
PCT Pub. Date: Oct. 14, 2021

(65) Prior Publication Data

US 2023/0121259 A1 Apr. 20, 2023

(30) Foreign Application Priority Data

Apr. 9, 2020 (EP) ..... 20168904

(51) Int. Cl.
*B65D 47/08* (2006.01)
*B65D 5/74* (2006.01)
(Continued)

(52) U.S. Cl.
CPC ..... *B65D 47/0876* (2013.01); *B65D 5/746* (2013.01); *B65D 47/103* (2013.01);
(Continued)

(58) Field of Classification Search
CPC ..... B65D 51/228; B65D 5/746; B65D 47/103
(Continued)

(56) References Cited

U.S. PATENT DOCUMENTS 5,992,659 A * 11/1999 Nofer ..... B65D 41/0471 222/541.9
11,040,806 B2 * 6/2021 Naumann ..... B65D 41/485
(Continued)

FOREIGN PATENT DOCUMENTS

CN 109803902 A 5/2019
EP 2949595 A1 12/2015
(Continued)

OTHER PUBLICATIONS

U.S. Appl. No. 17/913,918, Davide Morciano et al.
(Continued)

*Primary Examiner* — Anthony D Stashick
*Assistant Examiner* — L Kmet
(74) *Attorney, Agent, or Firm* — BUCHANAN INGERSOLL & ROONEY PC

(57) ABSTRACT

A spout is for a package having a designated pour opening and being filled with a pourable product. The spout comprises a collar carrying a pouring outlet, an inlet opening and a closing element controllable between an active position in which the closing element interrupts a fluidic connection between the pouring outlet and the inlet opening and an inactive position in which the closing element is configured to allow a fluidic connection between the pouring outlet and the inlet opening. The closing element comprises a peripheral portion contacting prior to a first control of the closing
(Continued)

element from the active position to the inactive position an inner surface of the collar along an initial contact portion. The inner surface comprises a main surface portion extending from the initial contact portion towards the pouring outlet and an auxiliary surface portion extending from the initial contact portion to the inlet opening.

12 Claims, 10 Drawing Sheets

(51) Int. Cl.
*B65D 47/10* (2006.01)
*B65D 51/22* (2006.01)

(52) U.S. Cl.
CPC ..... *B65D 47/106* (2013.01); *B65D 51/228* (2013.01); *B65D 2251/0025* (2013.01); *B65D 2251/0093* (2013.01)

(58) Field of Classification Search
USPC ..... 220/258.1
See application file for complete search history.

(56) References Cited

U.S. PATENT DOCUMENTS

| | | | | |
|---|---|---|---|---|
| 11,180,293 | B2 | 11/2021 | Sahara et al. | |
| 2004/0020943 | A1 | 2/2004 | Shinozaki et al. | |
| 2004/0112919 | A1 | 6/2004 | Krautkramer et al. | |
| 2015/0353247 | A1* | 12/2015 | Isogai | B65D 47/106 215/252 |
| 2016/0288961 | A1 | 10/2016 | Maguire | |
| 2016/0325879 | A1* | 11/2016 | Martini | B29C 66/542 |

FOREIGN PATENT DOCUMENTS

| | | | | |
|---|---|---|---|---|
| FR | 2903968 | A1 | | 1/2008 |
| JP | H09-226807 | A | | 9/1997 |
| JP | 3100548 | U | | 5/2004 |
| JP | 2011162215 | A | * | 8/2011 |
| JP | 2014-69809 | A | | 4/2014 |
| JP | 2018-510825 | A | | 4/2018 |
| JP | 2019-214421 | A | | 12/2019 |
| WO | 2014/115857 | A1 | | 7/2014 |

OTHER PUBLICATIONS

U.S. Appl. No. 17/907,170, Stefano Menozzi et al.
U.S. Appl. No. 17/913,943, Davide Morciano et al.
U.S. Appl. No. 17/914,025, Davide Morciano et al.
U.S. Appl. No. 17/914,119, Paolo Zanon et al.
International Search Report (PCT/ISA/210) and Written Opinion (PCT/ISA/237) mailed on May 26, 2021, by the European Patent Office as the International Searching Authority for International Application No. PCT/EP2021/058618. (9 pages).
Office Action (Decision of Refusal) issued on Dec. 4, 2025, in corresponding Japanese Patent Application No. 2022-549441 and English translation of the Office Action. (8 pages).

* cited by examiner

SPOUT FOR A PACKAGE, LID-SPOUT ASSEMBLY FOR A PACKAGE AND PACKAGE HAVING A SPOUT

TECHNICAL FIELD

The present invention relates to a spout for a package, in particular a package having a sealed main body, filled with a pourable product, even more particular filled with a pourable food product.

Advantageously, the present invention also relates to a lid-spout assembly for a package, in particular a package having a sealed main body, filled with a pourable product, even more particular filled with a pourable food product.

Advantageously, the present invention also relates to a package, in particular a package having a sealed main body, filled with a pourable product, even more particular filled with a pourable food product, and comprising a spout.

BACKGROUND ART

As is known, many liquid or pourable food products, such as fruit juice, UHT (ultra-high-temperature treated) milk, wine, tomato sauce, etc., are sold in packages, in particular sealed packages, made of sterilized packaging material.

A typical example is the parallelepiped-shaped package for pourable food products known as Tetra Brik Aseptic (registered trademark), which is made by sealing and folding a laminated strip packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Some of the known packages, in particular respective sealed main bodies of the packages formed from the packaging material, comprise a designated pour opening, which allows the outpouring of the pourable product from the packages. Typically, the designated pour opening is covered by a separation membrane, which isolates the inside of the package from the outer environment and which is to be opened or to be removed or to be ruptured or to be cut or to be pierced prior to the first outpouring of the pourable product so as to allow for the outpouring of the pourable product through the designated pour opening. It is also known to arrange a lid-spout assembly having a spout and a lid on the main body about the designated pour opening. The spout has a pouring outlet so as to allow for a controlled outpouring of the pourable product from the package and the lid allows to selectively close and open the pouring outlet.

The spout comprises a collar, which carries the pouring outlet at a first axial end and an inlet opening arranged at a second axial end. After the loss of integrity of the separation membrane it is possible with the lid being removed from the spout to pour the pourable product from the inner space of the package out of the pouring outlet. The pourable product flows from the inner space of the package through the inlet opening to the pouring outlet. Once the lid is arranged again on the spout, the lid impedes the outflow of the pourable product from the pouring outlet, however, the pourable product can, in dependence of the orientation of the package, still flow into a flow channel extending between the inlet opening and the pouring outlet of the collar.

There is known one type of spout, which is designed such to also block the possibility of the pourable product entering the flow channel, in particular with the lid closing the pouring outlet. Such a spout comprises a closing element, in particular being coupled to the lid. Such a closing element is fused to the separation membrane and/or defines partially or fully the separation membrane and is positioned such to seal the inlet opening. The closing element is configured such to contact a rim portion of the collar delimiting the inlet opening.

Typically, such a closing element comprises a coupling membrane fixing the closing element to the rim portion and which ruptures the first time the closing element is removed from the spout, in particular occurring by removal of the lid from the spout.

Then, each time the closing element is applied again onto the spout, the closing element should seal the inlet opening.

Even though such closing elements typically work well, the applicant has found that it may happen that the closing element does not correctly contact the rim portion once the coupling membrane has been ruptured, in particular after the lid is positioned again on the spout, so that the pourable product leaks into the flow channel.

Thus, the need is felt in the sector to improve such spouts in order to guarantee that the fluidic connection between the inner space of the package and the pouring outlet is interrupted with the lid being applied to the spout.

DISCLOSURE OF INVENTION

It is therefore an object of the present invention to provide in a straightforward and low-cost manner an improved spout for a package, in particular a package having a sealed main body, filled with a pourable product, even more particular filled with a pourable food product.

In particular, it is an object of the present invention to provide in a straightforward and low-cost manner an improved spout for a package, in particular a package having a sealed main body, filled with a pourable product, even more particular filled with a pourable food product, which allows to guarantee the selective sealing of the fluidic connection between an inner space of the package and a pouring outlet of the spout.

It is another object of the present invention to provide in a straightforward and low-cost manner an improved lid-spout assembly for a package, in particular a package having a sealed main body, filled with a pourable product, even more particular filled with a pourable food product.

In particular, it is an object of the present invention to provide in a straightforward and low-cost manner an improved lid-spout assembly for a package, in particular a package having a sealed main body, filled with a pourable product, even more particular filled with a pourable food product, which allows to guarantee the selective sealing of the fluidic connection between an inner space of the package and a pouring outlet of the spout.

It is a further object of the present invention to provide in a straightforward and low-cost manner a package, in particular a package having a sealed main body, filled with a pourable product, in particular filled with a pourable food product, having a spout, in particular the spout being designed to guarantee the selective sealing of the fluidic connection between an inner space of the package and a pouring outlet of the spout.

According to the present invention, there is provided a spout according to the independent claim.

Further advantageous embodiments of the spout are specified in the dependent claims 2 to 10.

BRIEF DESCRIPTION OF THE DRAWINGS

Five non-limiting embodiments of the present invention will be described by way of example with reference to the accompanying drawings, in which.

BEST MODES FOR CARRYING OUT THE INVENTION

Figure 1:
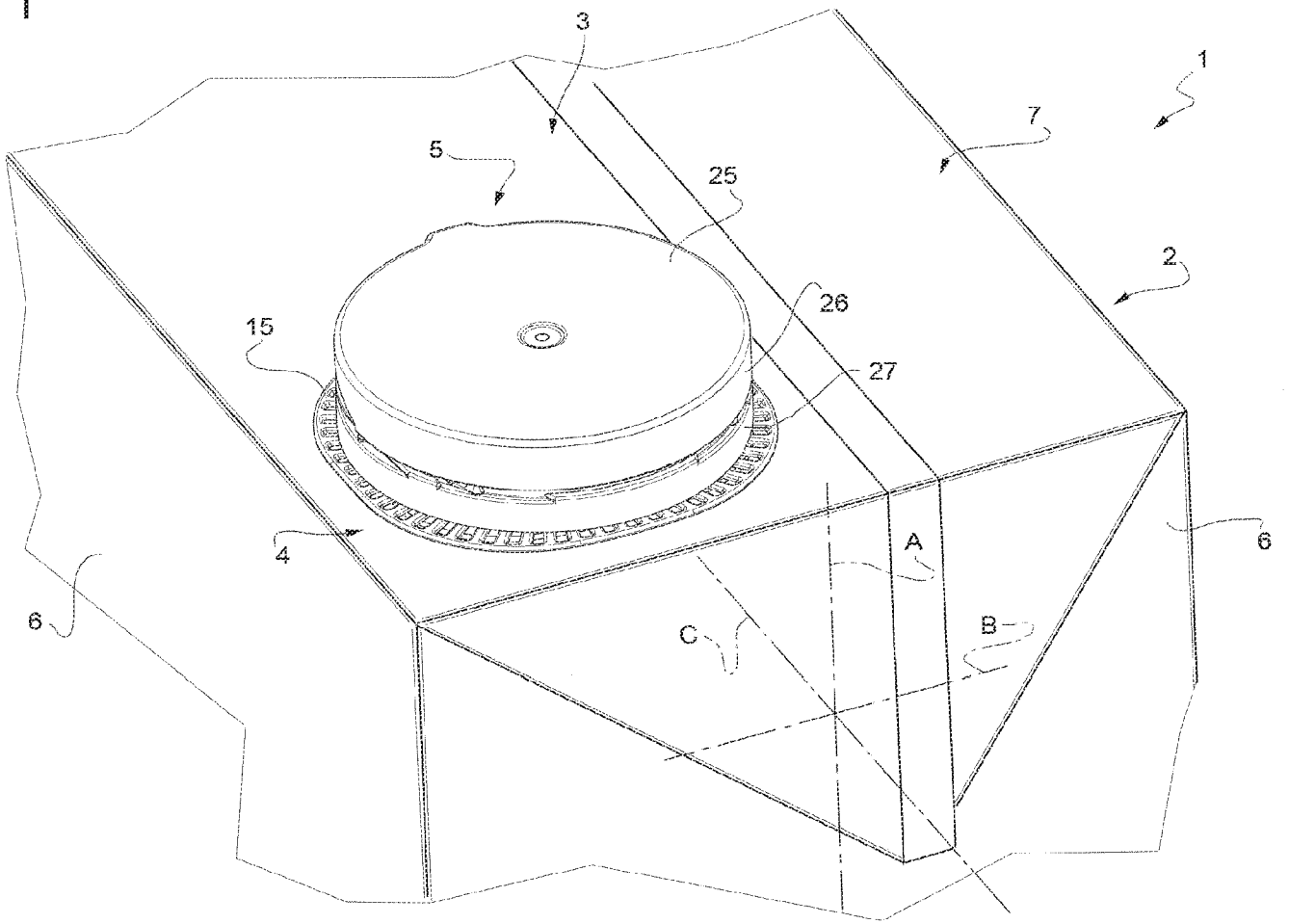
FIG. 1 is a schematic perspective view of a portion of a package having a spout according to a first embodiment of the present invention coupled to a respective lid, with parts removed for clarity.

Number 1 indicates as a whole a package (only partially shown to the extent necessary for the comprehension of the present invention) comprising:

- a sealed main body 2, in particular a sealed carton main body, being filled with a pourable product, in particular a pourable food product, and in particular having a designated pour opening (not shown and known as such) configured to allow for an outflow of the pourable product from main body 2; and
- a lid-spout assembly 3 coupled to the sealed main body 2 and having at least a spout 4 arranged and/or arrangeable about the designated pour opening and a lid 5 coupled and/or couplable to spout 4.

According to some preferred non-limiting embodiments, main body 2 is obtained from a packaging material, in particular a composite packaging material, having a multilayer structure (not shown and known as such).

Preferentially, the packaging material is provided in the form of a web.

Preferentially, main body 2 is obtained by forming a tube from the packaging material, longitudinally sealing the tube, filling the tube with the pourable product and by transversally sealing and cutting the tube.

Preferentially, the packaging material comprises at least one layer of fibrous material, such as e.g. paper or cardboard, and at least two layers of heat-seal plastic material, e.g. polyethylene, interposing the layer of fibrous material in between one another. One of these two layers of heat-seal plastic material defining the inner face of main body 2 contacting the pourable product.

Preferably, the packaging material also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially but not necessarily, the packaging material also comprises a further layer of heat-seal plastic material being interposed between the layer of gas- and light-barrier material and the layer of fibrous material.

According to a preferred non-limiting embodiment, spout(s) 4 is(are) applied to base package(s) 2 prior, during or after the formation, filling and sealing of main body(ies) 2.

Alternatively, spout(s) 4 can be applied onto the packaging material prior to arranging the packaging material within or during advancement of the packaging material through a packaging machine for forming, filling and sealing main bodies 2 from the packaging material.

In particular, application of spout(s) 4 to the packaging material or to main body 2 occurs by means of a molding process and/or adhesive bonding and/or ultrasonic bonding.

Preferentially, lid 5 is coupled to spout 4 prior or after application of spout 4 onto main body 2 or onto the packaging material.

Figure 2:
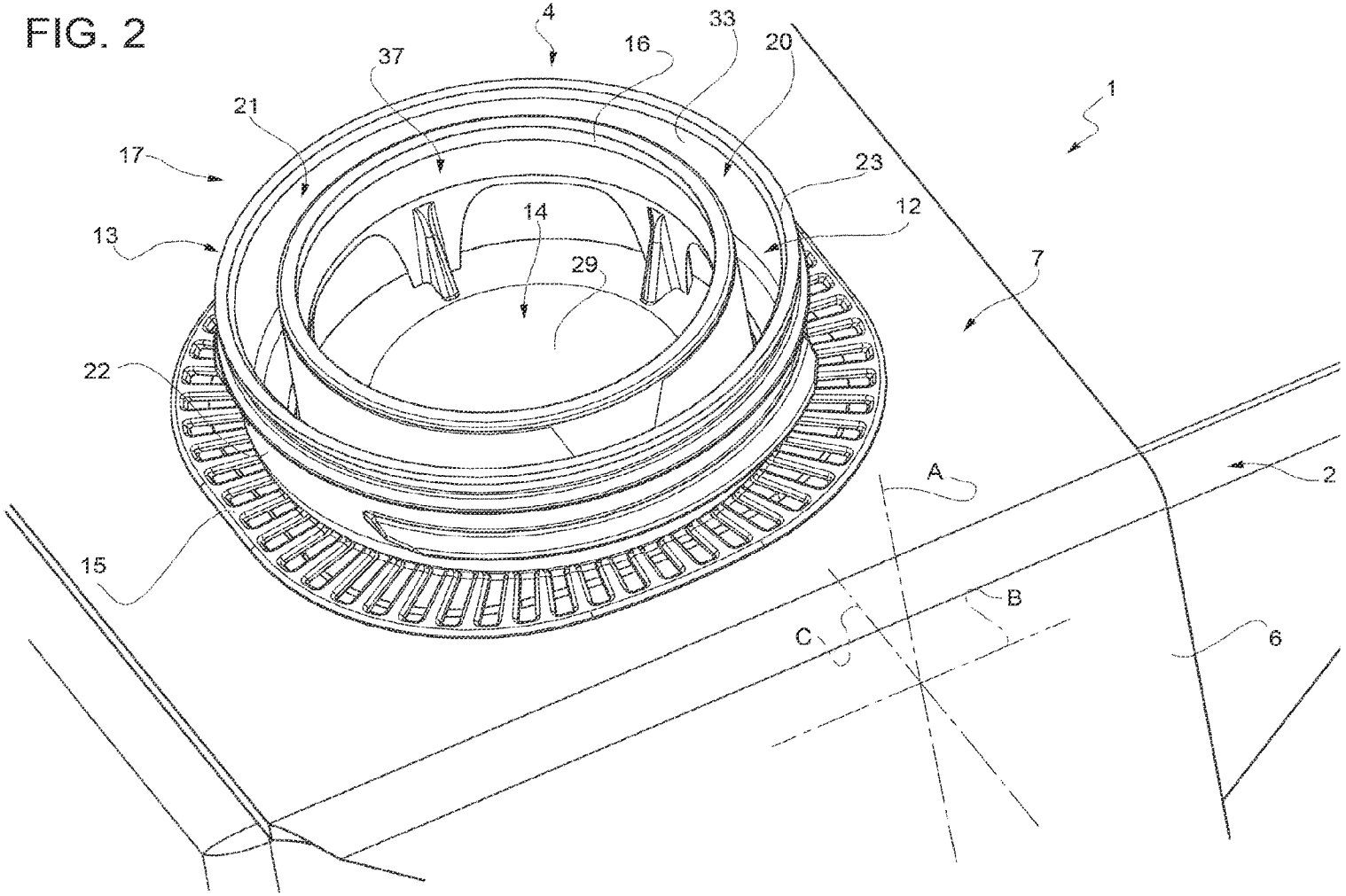
FIG. 2 is an enlarged top view of a portion of the package of FIG. 1, with parts removed for clarity.
Figure 3:
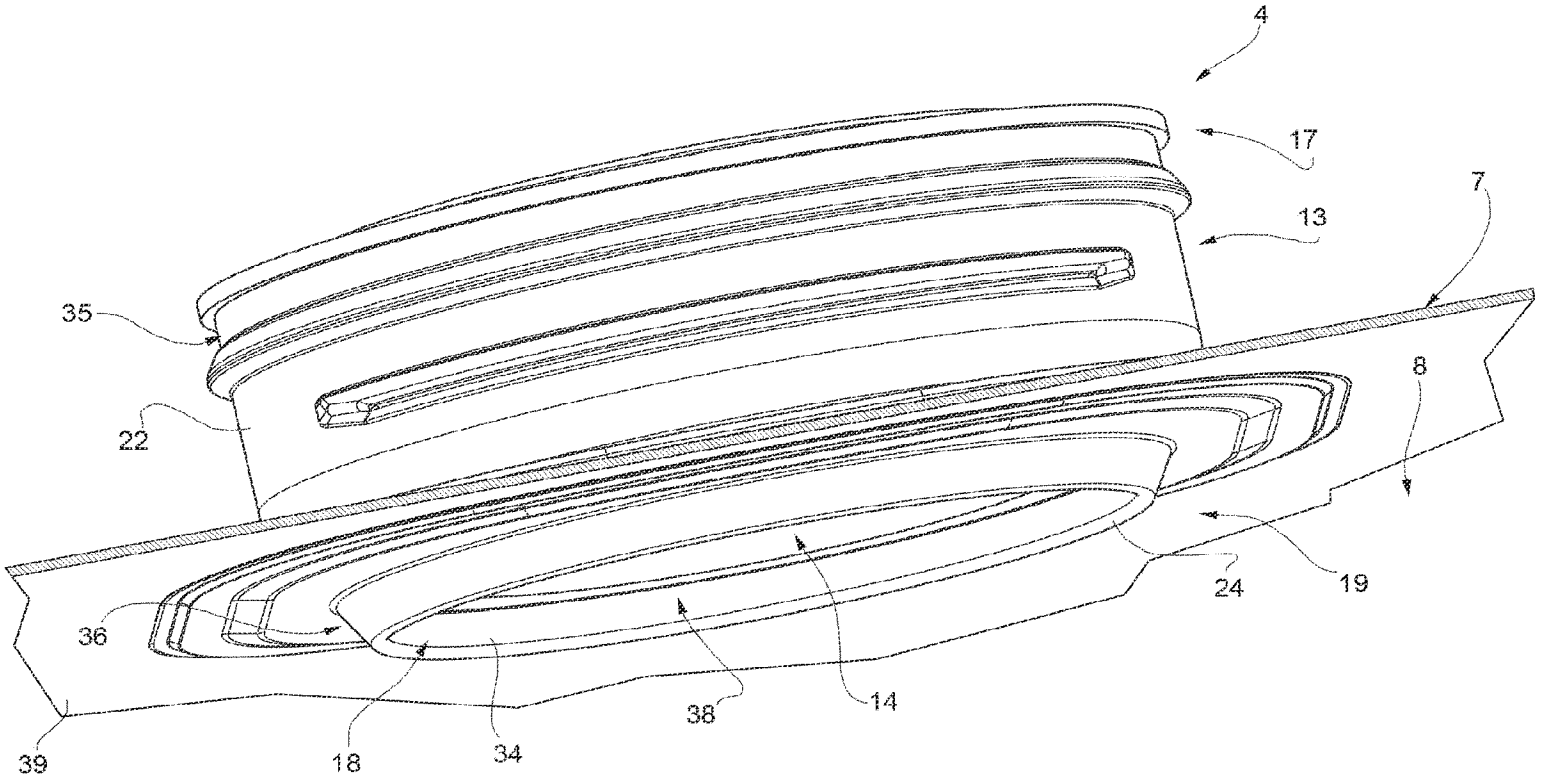
FIG. 3 is an enlarged perspective view of a detail of the spout of FIG. 1, with parts removed for clarity.
Figure 4:
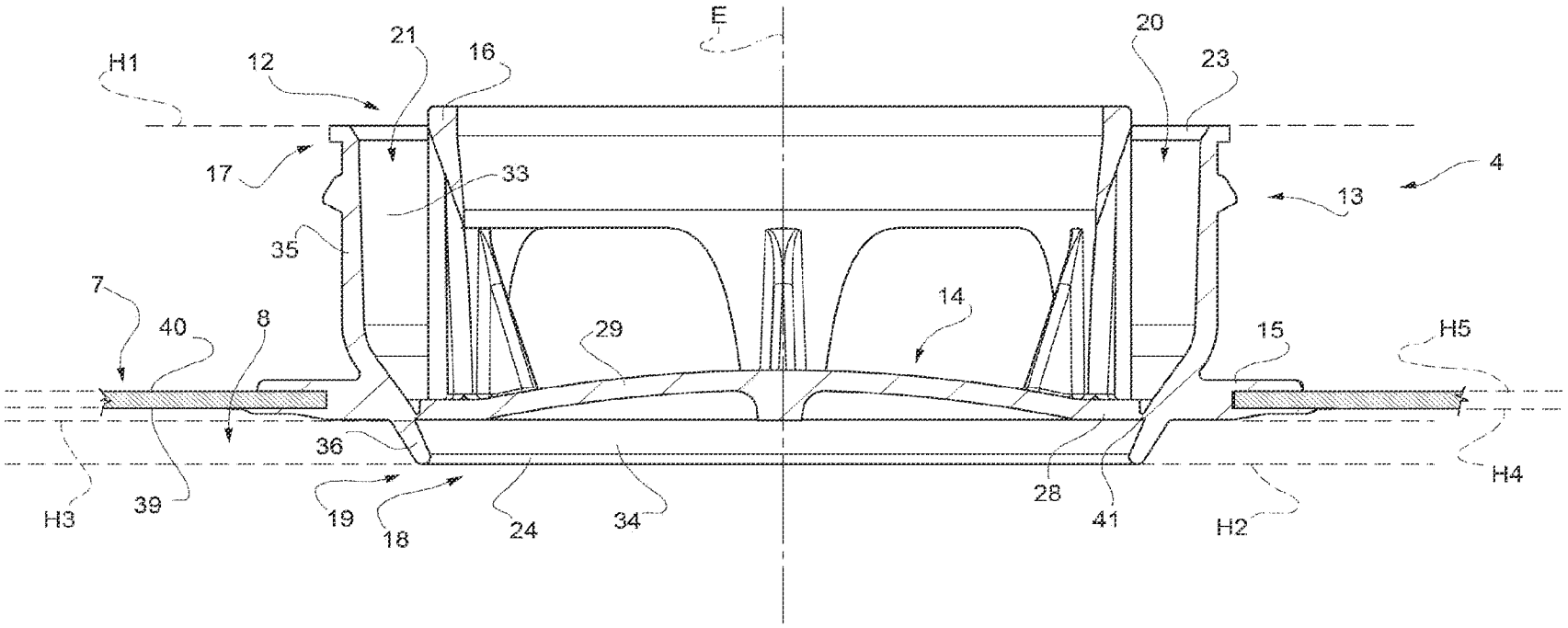
FIGS. 4, 5 and 6 are sectionized views of some portions of the spout of FIG. 1 being in different configurations, with parts removed for clarity.
Figure 5:
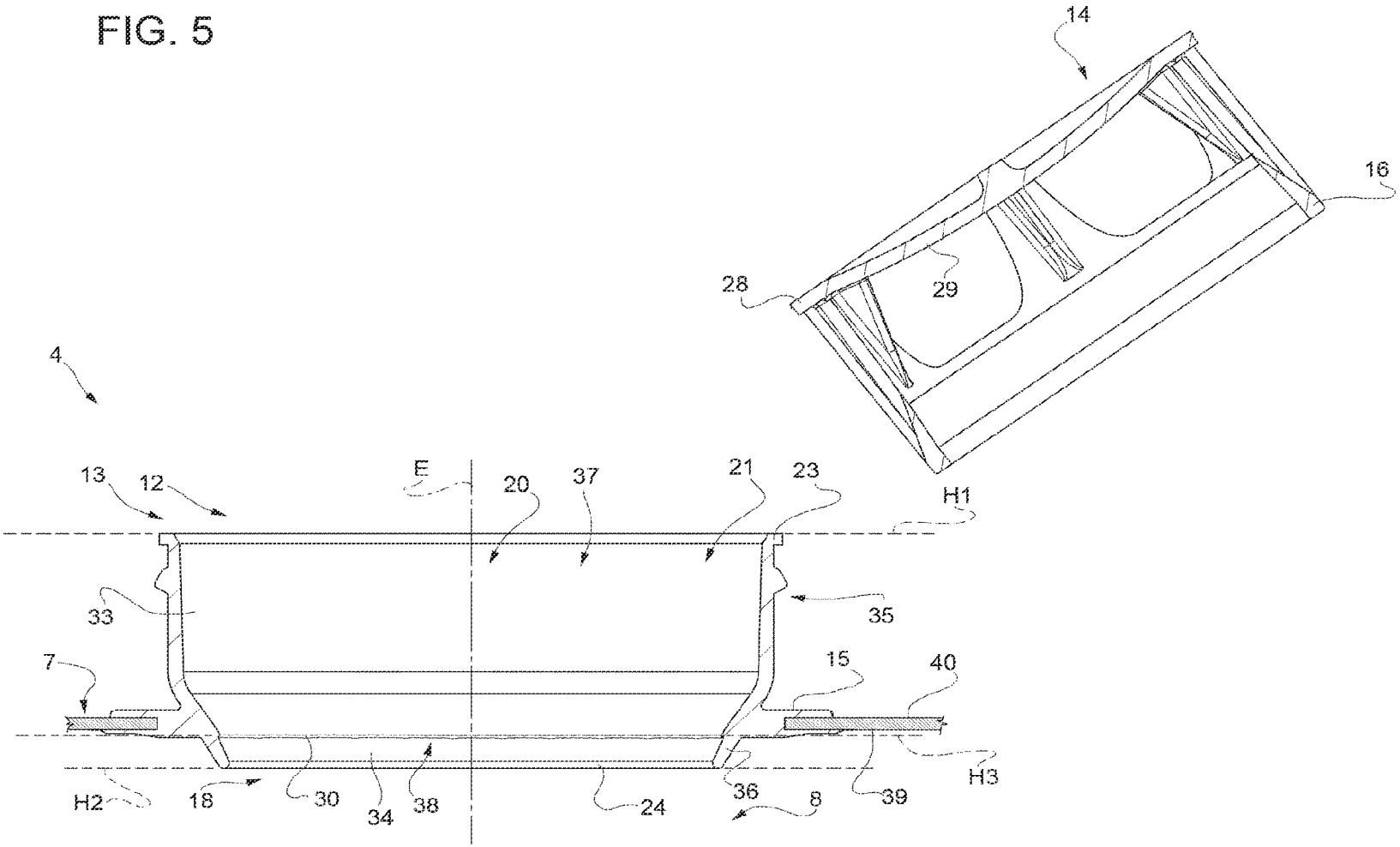
Figure 6:
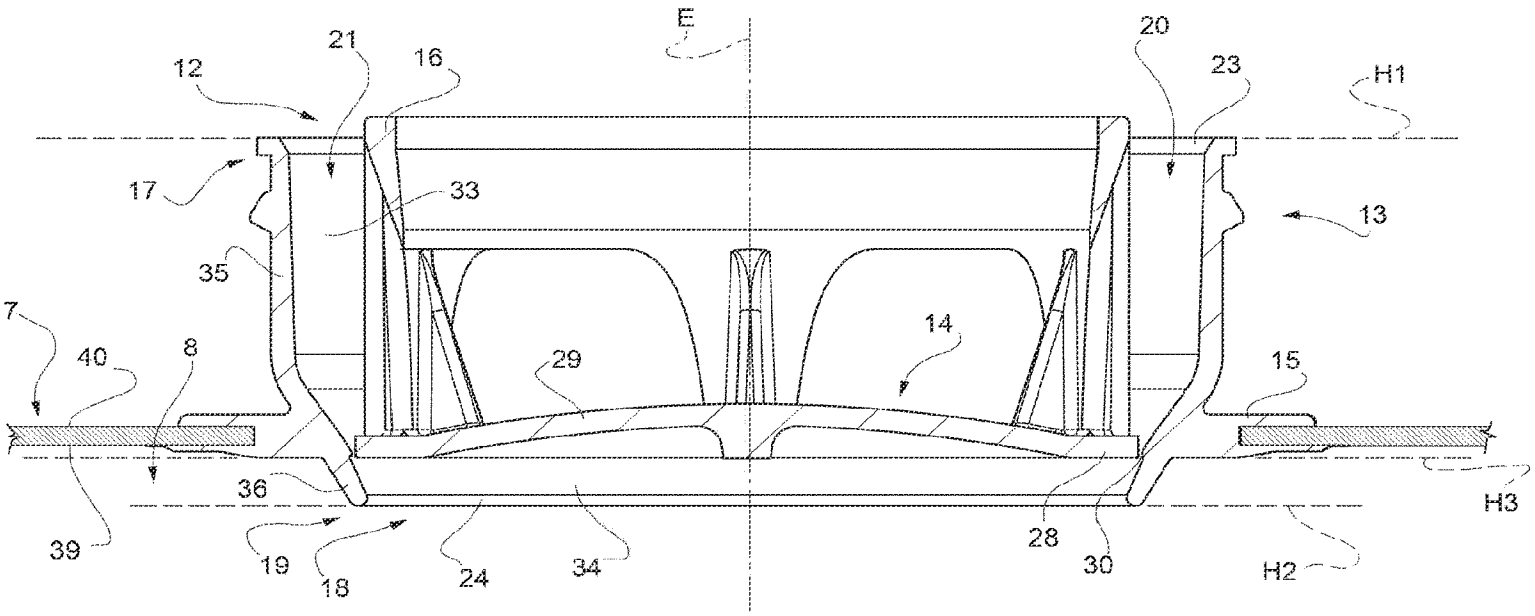

With particular reference to FIGS. 1 and 2, main body 2 extends along a longitudinal axis A, a first transversal axis B and a second transversal axis C. In particular, the extension of package 2 along longitudinal axis A is larger than the extension of package 2 along first transversal axis B and second transversal axis C.

Preferentially, main body 2 is parallelepiped-shaped.

According to some preferred non-limiting embodiments, main body 2 comprises a first wall portion (not shown and known as such), in particular being transversal, even more particular perpendicular, to longitudinal axis A, from which main body 2 extends along longitudinal axis A. Preferably, the first wall portion defines a support surface of package 1, in particular main body 2, which is designed to be put in contact with a support, such as e.g. a shelf, when, in use, being e.g. exposed within a sales point or when being stored. In particular, when being arranged on a support the first wall portion defines a bottom wall portion.

Preferably, main body 2 also comprises a plurality of lateral walls 6 being (fixedly) connected to the first wall portion and extending, in particular substantially parallel to longitudinal axis A, from the first wall portion.

Preferably, main body 2 also comprises a second wall portion 7 opposite to the first wall portion and being (fixedly) connected to at least some of lateral walls 6. In particular, lateral walls 6 are interposed between the first wall portion and second wall portion 7. In particular, when being arranged on a support, second wall portion 7 defines a top wall portion.

According to some non-limiting embodiments, the first wall portion and second wall portion 7 may be parallel to one another.

According to a non-limiting alternative embodiment not shown, the first wall portion and second wall portion 7 could be inclined with respect to one another.

According to some non-limiting embodiments, second wall portion 7 carries and/or comprises the designated pour opening.

According to some preferred non-limiting embodiments, package 1, in particular main body 2, comprises an inner space 8 configured to contain and/or containing the pourable product. In particular, the first wall portion, lateral walls 6 and second wall portion 7 delimit inner space 8.

According to a preferred non-limiting embodiment, main body 2 comprises a separation membrane (not shown and known as such) covering the designated pour opening. In particular, the separation membrane separates in the area of, in particular at, the designated pour opening inner space 8 from the outer environment. Preferentially, the separation membrane comprises a gas- and light-barrier material, e.g. aluminum foil or ethylene vinyl alcohol (EVOH) film.

In particular, during the first-time use (see further below for more details), the separation membrane is at least partially removed for allowing the pourable product to flow out of inner space 8 and main body 2.

According to a preferred non-limiting embodiment, the separation membrane is defined by a portion of the packaging material, in particular a portion of the layers of the packaging material being different from the layer of fibrous material.

Alternatively, the separation membrane could be defined alone or in addition by other portions of package 1.

With particular reference to FIGS. 1 to 6, spout 4 comprises at least:

- a pouring outlet 12 configured to allow for the outflow of the pourable product from package 1; and
- a collar 13 carrying (comprising) pouring outlet 12; and
- a closing element 14 configured to selectively control a fluidic connection of pouring outlet 12 with inner space 8, and in particular being operatively coupled to lid 5.

Preferentially, spout 4 also comprises a base frame 15 coupling and/or configured to couple spout 4 to main body 2, in particular to second wall portion 7, about the designated pour opening.

Preferentially, base frame 15 comprises a first annular portion and a second annular portion axially displaced from one another with respect to a longitudinal axis E of collar 13 and configured to interpose and/or interposing a portion of main body 2, in particular second wall portion 7, between one another. In particular, the portion of main body 2, in particular second wall portion 7, is at the designated pour outlet.

Preferentially, the first annular portion comprises a first engagement surface configured to contact an outer surface 40 of main body 2, in particular of second wall portion 7, and the second annular portion comprises a second engagement surface configured to contact an inner surface 39 of main body 2, in particular of second wall portion 7. In particular, the first engagement surface and the second engagement surface face one another.

Preferentially, spout 4 also comprises a coupling member 16 connected to closing element 14 and lid 5 and configured to operatively connect closing element 14 and lid 5 to one another. In particular, coupling member 16 is configured to couple lid 5 and closing element 14 in such a manner that any movement of lid 5 results in a concurrent movement of closing element 14. Even more particular, coupling member 16 is inseparably connected (under normal working conditions) to lid 5 and closing element 14.

According to some preferred non-limiting embodiments, spout 4, in particular collar 13 and closing element 14, preferentially also base frame 15 and coupling member 16, is/are formed and/or molded from a polymer.

Preferentially, also lid 5 is formed and/or molded from a polymer.

According to some preferred non-limiting embodiments, coupling member 16 is fused and/or welded and/or bond and/or molded to lid 5.

In more detail, collar 13 extends along longitudinal axis E, in particular in the non-limiting embodiment shown parallel to longitudinal axis A, and carries (comprises) pouring outlet 12 at a first axial end 17 of collar 13 itself and an inlet opening 18 for the pourable product at a second axial end 19 of collar 13 itself opposite to first axial end 17. In particular, collar 13 delimits (and/or comprises) a flow channel 20 for the pourable product extending between inlet opening 18 and pouring outlet 12. In use, collar 13 is configured such to receive the pourable product from inner space 8 through inlet opening 18 and such that the pourable product flows out of pouring outlet 12.

Preferentially, pouring outlet 12 and inlet opening 18 extend within respectively a first plane H1 and a second plane H2 being axially displaced from first plane H1 with respect to longitudinal axis E. In particular, first plane H1 and second plane H2 are perpendicular to longitudinal axis E.

Preferentially, collar 13 comprises an inner surface 21 delimiting flow channel 20.

Even more preferentially, collar 13 also comprises an outer surface 22 opposite to inner surface 21.

Preferentially, collar 13 comprises a first rim 23 arranged at first axial end 17 and delimiting pouring outlet 12 and a second rim 24 arranged at second axial end 18 and delimiting inlet opening 18.

In particular, collar 13 has a tubular configuration.

Even more particular, collar 13 has an annular cross-sectional profile with respect to a cross-sectional plane perpendicular to longitudinal axis E.

In particular, collar 13 is or is controllable in fluidic connection with the designated pour opening and/or at least partially extends through the designated pour opening and into inner space 8.

In more detail, closing element 14 is operatively coupled to lid 5, in particular by means of coupling member 16, and is arranged and/or is arrangeable within flow channel 18. In particular, closing element 14 is configured to selectively control a fluidic connection between inlet opening 18 and pouring outlet 12.

In even more detail, closing element 14 is controllable between an active position (see FIGS. 2, 3, 4 and 6) in which closing element 14 is configured to interrupt a fluidic connection between pouring outlet 12 and inlet opening 16 and an inactive position (see FIG. 5) in which closing element 14 is configured to allow for a fluidic connection between pouring outlet 12 and inlet opening 16.

According to some preferred non-limiting embodiments, closing element 14 is connected, in particular fused, to the separation membrane. In particular, during control of closing element 14 between the active position and the inactive position also separation membrane changes its position.

According to some alternative non-limiting embodiments, closing element 14 could at least partially define the separation membrane.

According to a preferred non-limiting embodiment, closing element 14 and collar 13 are molded in a single piece.

According to some preferred non-limiting embodiments, lid 5 is controllable between at least:

- a closing configuration, in which lid 5 is configured to cover and/or covers pouring outlet 12, in particular for impeding an outflow of the pourable product out of pouring outlet 12; and
- an open configuration in which lid 5 is configured to be and/or is detached from pouring outlet 12, in particular for allowing an outflow of the pourable product through pouring outlet 12.

According to some preferred non-limiting embodiments, lid 5 comprises a top wall 25 configured to cover the pouring outlet with lid 5 being controlled in the closing configuration and a side wall 26 protruding from top wall 25 and being configured to at least partially surround collar 13 with lid 5 being arranged in the closing configuration.

Preferentially, top wall 25 and side wall 26 delimit an internal space having a (substantially) cylindrical shape. In particular, the internal space houses, with lid 5 being arranged in the closing configuration, at least a portion of collar 13 and flow channel 20.

Preferentially, coupling member 16 is connected to top wall 25, in particular an inner surface of top wall 25, the inner surface of top wall 25 facing the internal space.

Please note that lid 5 has been omitted from FIGS. 2 to 6. However, after formation of packages 1 has been finalized, lid 5 and coupling member 16 are always connected to one another in order to guarantee a permanent coupling of lid 5 and closing element 14.

Advantageously, lid-spout assembly 3 also comprises a coupling ring 27 configured to be arranged and/or being arranged around at least a portion of spout 4, in particular around at least a portion of collar 13, in particular such that coupling ring 27 is inseparable from spout 4, in particular from collar 13.

Preferentially, lid-spout assembly 3 also comprises rupturable coupling bridges connecting coupling ring 27 and lid 5 with one another. The coupling bridges are designed to irreversibly rupture during the first control of lid 5 from the closing configuration to the open configuration.

Preferentially, lid 5 is hinged to coupling ring 27 and is adapted to angularly move around a hinge axis. In particular, the hinge axis being transversal, in particular perpendicular, to longitudinal axis E and/or longitudinal axis A.

Preferentially, lid 5 is movable between at least a first angular position and a second angular position around the hinge axis at which lid 5 is controlled in respectively the closing configuration and the open configuration.

Preferentially, lid 5 and closing element 14 are coupled such that closing element 14 is in the active position and in the inactive position with lid 5 being respectively in the closing configuration and in the open configuration.

In particular, closing element 14 is in a respective first angular position (see FIGS. 4 and 6) and in a respective second angular position (see FIG. 5) with respect to the hinge axis when being respectively in the active position and in the inactive position and is configured to angularly move around the hinge axis between the respective first angular position and the respective second angular position.

It should be noted that package 1, immediately after its formation, is in an initial configuration in which lid 5 and closing element 14 are respectively in the closing configuration and in the active position. Package 1 is distributed and/or sold to a user while being in the initial configuration.

With particular reference to FIGS. 2 to 6, closing element 14 comprises at least a peripheral portion 28, in particular having an annular shape and, contacting and/or being configured to contact inner surface 21 at a respective contact portion of inner surface 21 and with closing element 14 being in the active position.

Preferentially, closing element 14 also comprises a central wall 29 connected to and extending, in particular radially extending, from peripheral portion 28, in particular towards a center of closing element 14.

In particular, closing element 14 is integral and/or continuous meaning that closing element 14, in particular peripheral portion 28 and central wall 29, do(es) not comprise any passages and/or through-holes.

According to the preferred non-limiting embodiment shown, central wall 29 is concave with respect to first plane H1.

Preferentially, central wall 29 is curved, in particular towards pouring outlet 12 and/or first rim 23 with lid 5 being in the active position. In particular, central wall 29 is curved such that a center point of central wall 29 is arranged closer to pouring outlet 12 and/or first rim 23 than peripheral portion 28 with respect to longitudinal axis E and with lid 5 being in the active position.

Alternatively, central wall 29 could be curved towards inlet opening 18 and/or second rim 24 with lid 5 being in the active position. According to such an alternative embodiment, the center point of central wall 29 is arranged closer to inlet opening 18 and/or second rim 24 than peripheral portion 28 with respect to longitudinal axis E and with lid 5 being in the active position.

Advantageously, prior to a first control of closing element 14 from the active position to the inactive position (i.e. while package 1 is in the initial configuration) peripheral portion 28 contacts inner surface 21 along an initial contact portion 30, in particular having an annular shape, of inner surface 21.

In particular, by peripheral portion 28 being in contact with inner surface 21 a sealing effect at the interface of peripheral portion 28 and inner surface 21 is achieved.

In the ideal case and with closing element 14 being arranged in the active position, peripheral portion 28 would always contact initial contact portion 30. Thus, in the ideal case, the contact portion always corresponds to initial contact portion 30. However, in practice the contact portion may vary from initial contact portion 30.

In order to guarantee the sealing between inner surface 21 and peripheral portion 28, initial contact portion 30 is arranged such that inner surface 21 comprises:

- a main surface portion 33 extending from initial contact portion 30 towards (and to) pouring outlet 12 and/or first rim 23; and
- an auxiliary surface portion 34 extending from initial contact portion 30 towards and to inlet opening 18 and/or second rim 24.

Thus, by arranging closing element 14 such that inner surface 21 comprises not only a main surface portion 33, but also an auxiliary surface portion 34 it is guaranteed that also independently of the exact position of the contact portion, a sealing between peripheral portion 28 and inner surface 21 is guaranteed, even in the case of peripheral portion 28 partially deflecting towards inlet opening 18 and/or second rim 24.

In particular, initial contact portion 30 is axially displaced (with respect to longitudinal axis E) from inlet opening 18 and/or second rim 24 and towards pouring outlet 12 and/or first rim 23.

Preferentially, initial contact portion 30 lies within a third plane H3, in particular distinct from and parallel to first plane H1 and second plane H2. In particular, third plane H3 is perpendicular to longitudinal axis E.

In particular, third plane H3 is interposed between first plane H1 and second plane H2.

Overall, closing element 14 does not interact with second rim 24 for directly closing inlet opening 18, but leaves inlet opening 18 open, while being arrangeable and/or arranged between inlet opening 18 and pouring outlet 12.

According to some preferred non-limiting embodiments, an axial distance (with respect to longitudinal axis E) between second plane H2 and third plane H3 is larger than a thickness of peripheral portion 28. In particular, the axial distance is at least twice, preferentially at least three times, even more particular at least four times the thickness of peripheral portion 28.

According to some preferred non-limiting embodiments, collar 13 comprises a main portion 35 having main surface portion 33 and an auxiliary portion 36, in particular being ring-shaped and, having auxiliary surface portion 34.

Preferentially, main surface portion 33 and auxiliary surface portion 34 define and/or delimit respectively a main space 37 and an auxiliary space 38 of flow channel 20.

In particular, closing element 14 is configured to impede any pourable product to enter main space 37 when being arranged in the active position.

In particular, auxiliary space 38 has a frustoconical shape. Even more particular, auxiliary space 38 tapers towards inlet opening 18 and/or second rim 24.

According to the non-limiting embodiment shown in FIGS. 2 to 6, spout 4 is configured such that with spout 4 being coupled to main body 2, in particular to top wall 25, auxiliary surface portion 34 (and auxiliary portion 36) is(are) at least partially positioned within inner space 8.

In particular, with spout 4 being coupled to main body 2, in particular top wall 25, auxiliary surface portion 34 (and auxiliary portion 36) protrude(s) into main body 2, in particular inner space 8, and main surface portion 33 (and main portion 35) extend(s) away from main body 2, in particular inner space 8.

According to some preferred non-limiting embodiments, second wall portion 7 comprises inner surface 39 facing inner space 8 and outer surface 40 opposite to inner surface 39. In particular, inner surface 39 and outer surface 40 are arranged, in particular at the designated pour outlet, within respectively a fourth plane H4 and a fifth plane H5, in particular transversal, even more particular perpendicular, to longitudinal axis E.

Preferentially, third plane H3 is axially distanced from fifth plane H5, in particular also from fourth plane H4, with respect to longitudinal axis E and towards inlet opening 18.

According to the non-limiting embodiment shown in FIGS. 2 to 6, closing element 14 is interposed between inlet opening 18 and the second engagement surface.

According to some preferred non-limiting embodiments, spout 4, in particular closing element 14, even more particular peripheral portion 28, further comprises a coupling membrane 41 fixing closing element 14 to inner surface 13 prior to the first control of closing element 13 from the active position to the inactive position. In particular, the coupling membrane 41 guarantees sealing of inner space 8 prior to the first control of closing element 14 from the active position to the inactive position.

Preferentially, coupling membrane 41 is configured to irreversibly rupture (see FIGS. 4 to 6) during the first control of closing element 14 from the active position to the inactive position. This means that after the rupture of coupling membrane 41 only the contact between inner surface 21 and peripheral portion 28 guarantees the interruption of the fluidic connection between inlet opening 18 and pouring outlet 12.

In use, a user receives package 1 with lid 5 and closing element 14 being respectively in the closing configuration and the active position so as to respectively cover pouring outlet 12 and to impede any fluidic connection between inlet opening 18 and pouring outlet 12.

Prior to the first control of lid 5 from the closing configuration to the open configuration and of closing element 14 from the active position to the inactive position, peripheral portion 28 contacts initial contact portion 30. In particular, the sealing effect obtained is (initially) guaranteed by coupling membrane 41.

The user, in order to access the pourable product, needs to control lid 5 from the closing configuration to the open configuration leading to a control of closing element 14 from the active position to the inactive position allowing the pourable product to flow from inner space 8 through inlet opening 18 into flow channel 20 and out of flow channel 20 through pouring outlet 12.

When closing element 14 is moved from the active position to the inactive position for the first time, coupling membrane 41 irreversibly ruptures. In particular, also the rupturable coupling bridges irreversibly rupture.

Lid 5 and closing element 14 can be reversibly controlled in respectively the closing configuration and the open configuration and the active position and inactive position so as to selectively control whether to impede or allow the outpouring of the pourable product.

Each time closing element 14 is arranged again in the active position, peripheral portion 28 contacts the contact portion of inner surface 21. The contact portion can correspond to initial contact portion 30 but can also deviate therefrom. In any case, interaction between peripheral portion 28 and inner surface 21 guarantees that closing element 14 interrupts the fluidic connection between inlet opening 18 and pouring outlet 12, meaning that the pourable product cannot flow into main space 37, which might otherwise occur if the orientation of package 1 promotes such a flow.

Figure 7:
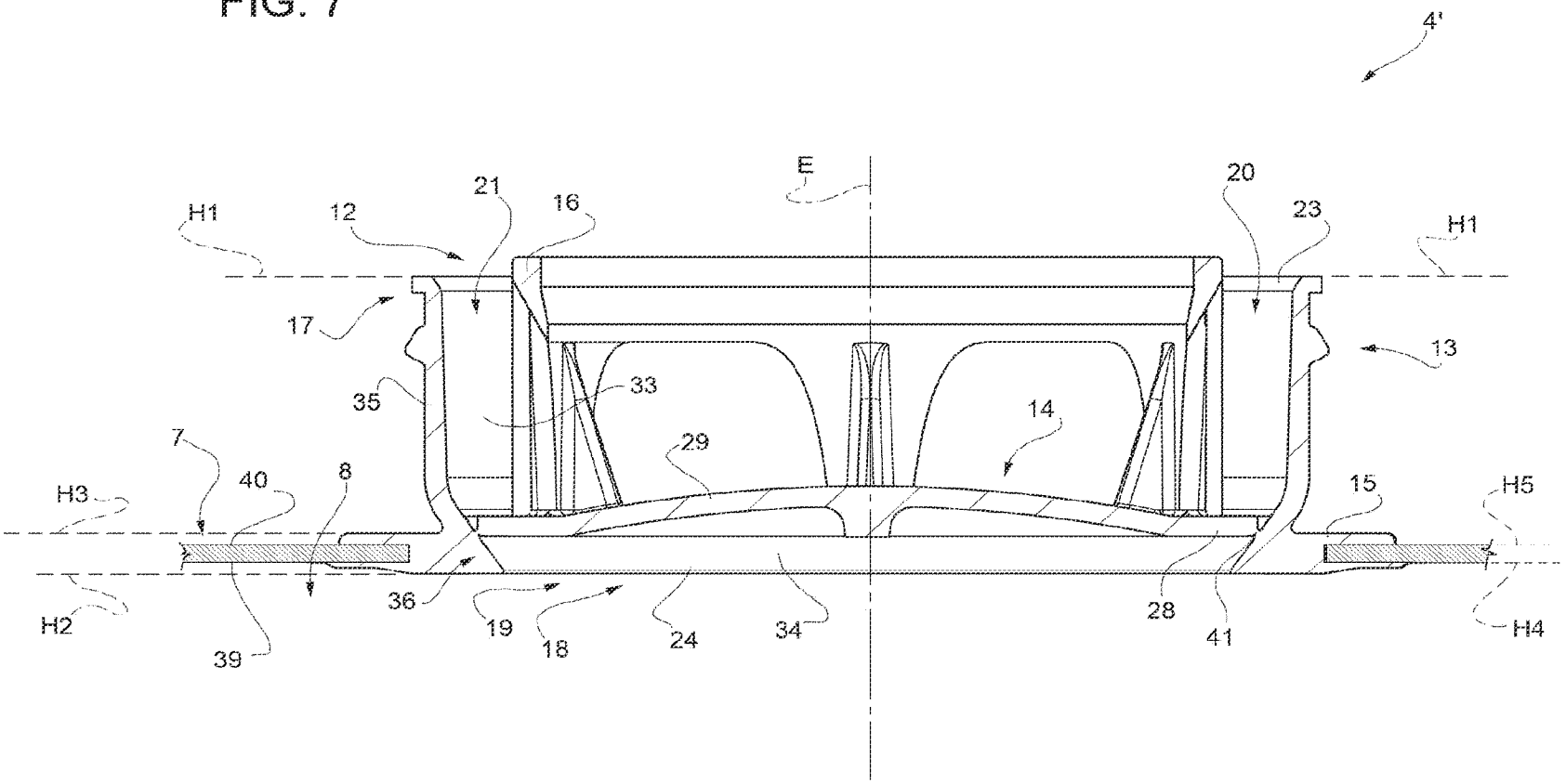
FIG. 7 is a sectionized view of some details of a spout according to a second embodiment of the present invention, with parts removed for clarity.

With reference to FIG. 7, number 4' indicates an alternative embodiment of a spout of lid-spout assembly 3 according to the present invention; as spout 4' is similar to spout 4, the following description is limited to the differences between them, and using the same references, where possible, for identical or corresponding parts.

In particular, spout 4' differs from spout 4 in that closing element 14 is interposed between the second engagement surface and pouring outlet 12.

In particular, third plane H3 is axially displaced out of inner space 8.

In particular, at least a portion of auxiliary surface portion 34 (and auxiliary portion 36) is arranged outside of inner space 8.

In particular, with spout 4 being coupled to main body 2, in particular top wall 25, auxiliary surface portion 34, auxiliary portion 36, main surface portion 33 and main portion 35 extend(s) away from main body 2, in particular inner space 8.

Preferentially, third plane H3 is interposed between pouring outlet 12 and/or first rim 23 and fourth plane H4, and in particular also fifth plane H5.

As the operation of package 1 having spout 4' is similar to the one of package 1 having spout 4, we refer to the above-provided description.

Figure 8:
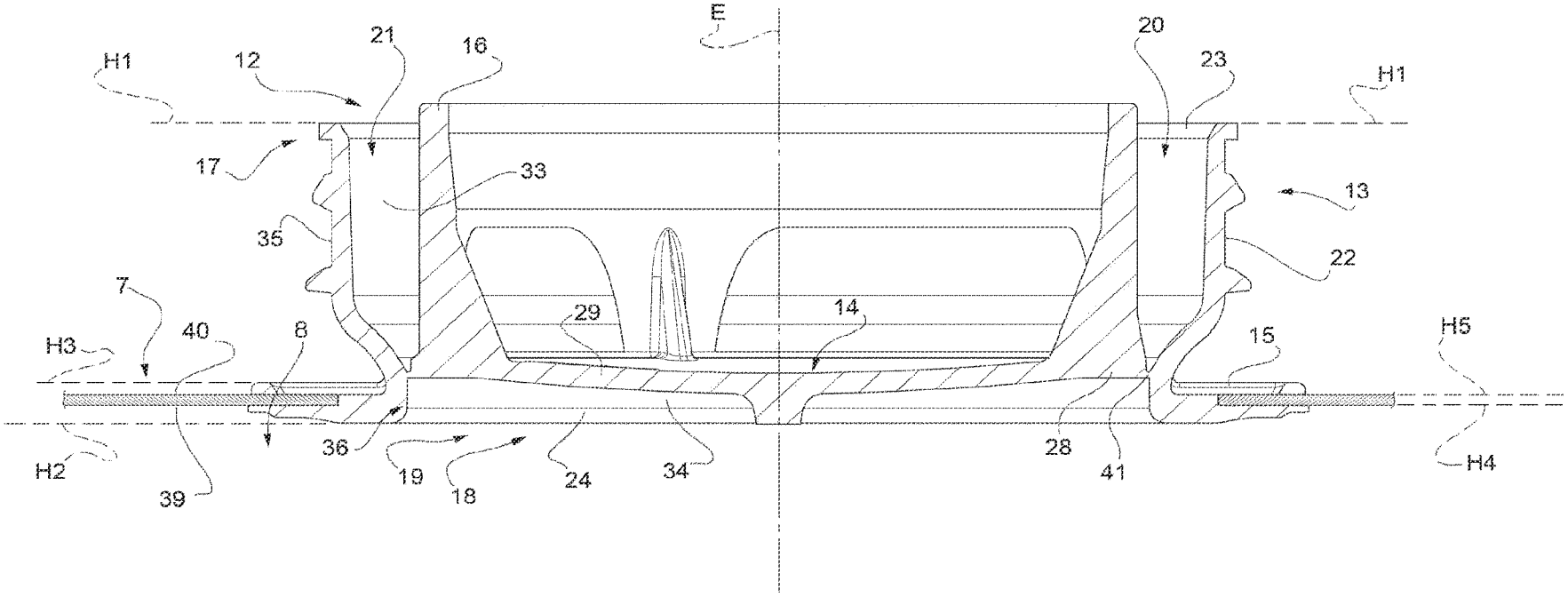
FIG. 8 is a sectionized view of some details of a spout according to a third embodiment of the present invention, with parts removed for clarity.

With reference to FIG. 8, number 4" indicates an alternative embodiment of a spout of lid-spout assembly 3 according to the present invention; as spout 4" is similar to spout 4', the following description is limited to the differences between them, and using the same references, where possible, for identical or corresponding parts.

In particular, spout 4" differs from spout 4' in that auxiliary surface portion 34 is transversal to main surface portion 33.

According to some preferred non-limiting embodiments, auxiliary surface portion 34 is parallel to longitudinal axis E and main surface portion 33 is transversal to longitudinal axis E.

Preferentially, a first slope of auxiliary surface portion 34 and a second slope of main surface portion 33 are such that initial contact portion 30 defines a plurality of inflection points. In particular, the first slope and the second slope are defined with respect to an intersection plane comprising longitudinal axis E (i.e. longitudinal axis E lies on the intersection plane and longitudinal axis E and the interaction plane are parallel to one another). This intersection plane intersects with inner surface 21 obtaining a one-dimensional curve (in particular two one-dimensional curves as the intersection plane intersects with two different portions of inner surface 21). Each one-dimensional curve comprises a first portion and a second portion lying on respectively auxiliary surface portion 34 and main surface portion 33. A respective intersection point between the first portion and the second portion corresponds to a respective point of initial contact portion 30. Preferentially, each intersection point is an inflection point of the respective one-dimensional curve.

In particular, spout 4" also differs from spout 4' in that auxiliary space 38 has a (substantially) cylindrical shape, i.e. a cross-sectional diameter with respect to a cross-sectional plane perpendicular to longitudinal axis E remains (substantially) constant independently of the axial position of the cross-sectional plane.

Preferentially, main space 37 has a frustoconical shape. Even more preferentially, main space 37 tapers towards inlet opening 18 and/or second rim 24.

Preferentially, spout 4" also differs from spout 4' in that central wall 29 is convex with respect to first plane H1.

In particular, central wall 29 is curved towards inlet opening 18 and/or second rim 24 with lid 5 being in the active position. In particular, central wall 29 is curved such that the center point is arranged closer to inlet opening 18 and/or second rim 24 than peripheral portion 28 with respect to longitudinal axis E and with lid 5 being in the active position.

As the operation of package 1 having spout 4" is similar to the one of package 1 having spout 4' or spout 4, we refer to the above-provided description.

Figure 9:
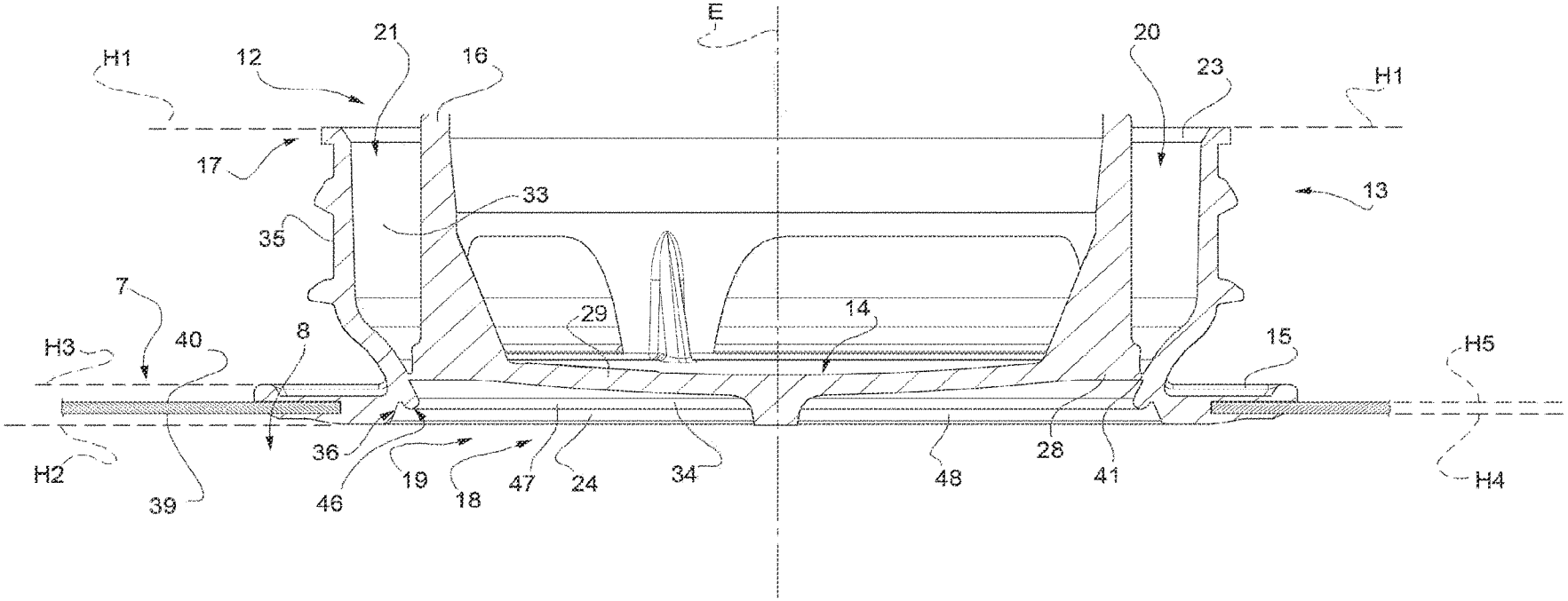
FIG. 9 is a sectionized view of some details of a spout according to a fourth embodiment of the present invention, with parts removed for clarity.

With reference to FIG. 9, number 4'" indicates an alternative embodiment of a spout of lid-spout assembly 3 according to the present invention; as spout 4'" is similar to spout 4', the following description is limited to the differences between them, and using the same references, where possible, for identical or corresponding parts.

In particular, spout 4'" differs from spout 4' in that auxiliary portion 36 comprises at least an annular lip 46 connected to main portion 35 and protruding from main portion 35 and towards inlet opening 18. Preferentially, annular lip 46 delimits a portion of auxiliary space 38, in particular having a frustoconical shape. Preferentially, the portion of auxiliary space 38 tapers towards inlet opening 18 and/or second rim 24.

Preferentially, a terminal edge 47 of annular lip 46 is interposed between inlet opening 18 and initial contact portion 30 (in other words, terminal edge 47 is interposed between second plane H2 and third plane H3.

According to some preferred non-limiting embodiments, auxiliary portion 36 also comprises an end section 48 connected to annular lip 46 and carrying second rim 24. In particular, end section 48 delimits a further portion of auxiliary space 38, in particular also having a frustoconical shape. In particular, the further portion of auxiliary space 38 tapers from inlet opening 18 towards initial contact portion 30.

Preferentially, a minimum diameter of end section 48 is larger than a diameter of annular lip 46 at terminal edge 4.

As the operation of package 1 having spout 4'" is similar to the one of package 1 having spout 4" or spout 4' or spout 4, we refer to the above-provided description.

Figure 10:
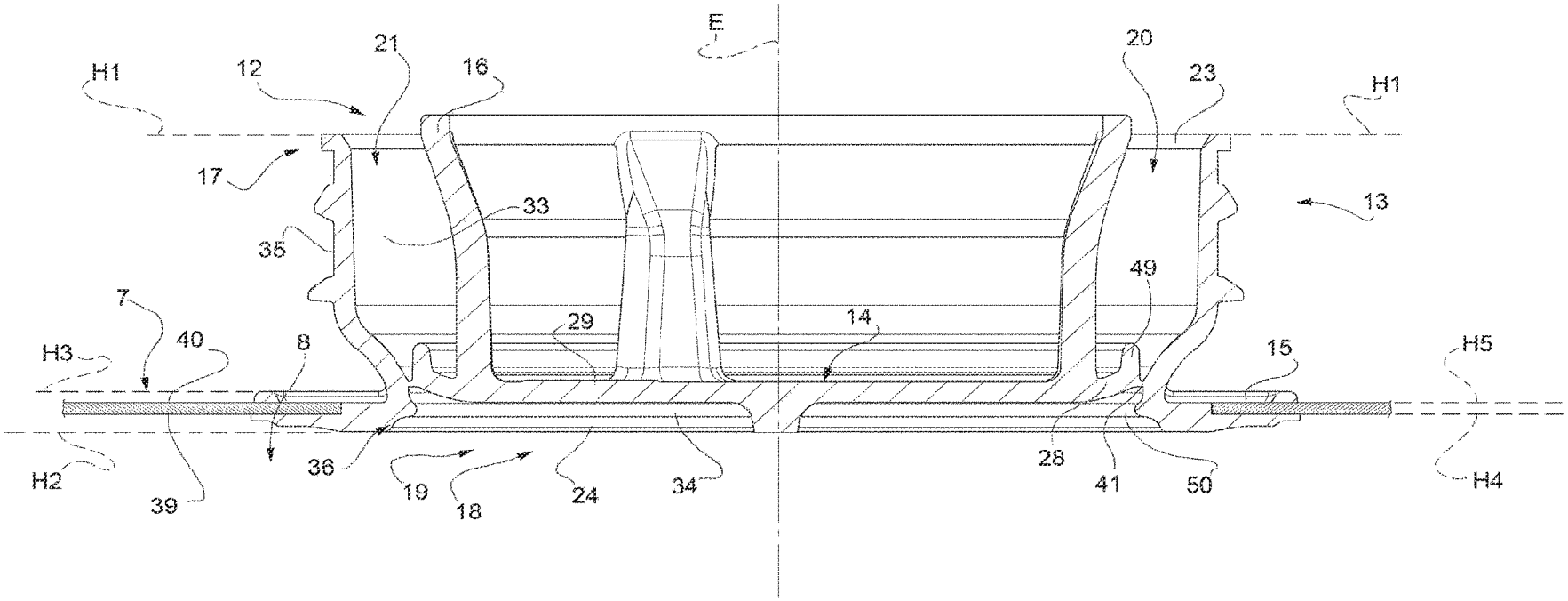
FIG. 10 is a sectionized view of some details of a spout according to a fifth embodiment of the present invention, with parts removed for clarity.

With reference to FIG. 10, number 4"" indicates an alternative embodiment of a spout of lid-spout assembly 3 according to the present invention; as spout 4"" is similar to spout 4'", the following description is limited to the differences between them, and using the same references, where possible, for identical or corresponding parts.

In particular, spout 4"" differs from spout 4' in that closing element 14 further comprises a contact ring 49 connected to and protruding from peripheral portion 28. Advantageously, contact ring 49 is configured to contact inner surface 21, in particular in order to increase a sealing surface between closing element 14 and inner surface 21, in particular with respect to the embodiment of FIG. 7, with lid 5 being in the active position.

According to some preferred non-limiting embodiments, contact ring 49 extends from peripheral portion 28 and towards top wall 25.

In particular, spout 4"" also differs from spout 4' in that auxiliary portion 36 also comprises an annular restriction lip 50 arranged between initial contact portion 30 and inlet opening 18. In particular, annular restriction lip 50 protrudes towards a center of auxiliary portion 36.

Preferentially, a diameter of annular restriction lip 50 is smaller than a diameter of auxiliary portion 36 at second rim 24.

As the operation of package 1 having spout 4"" is similar to the one of package 1 having spout 4', we refer to the above-provided description.

The advantages of spout 4, spout 4', spout 4", spout 4'", spout 4"" and/or of lid-spout assembly 3 and/or of package 1 according to the present invention will be clear from the foregoing description.

In particular, by having an inner surface 21 comprising a main surface portion 33 and an auxiliary surface portion 34 it is guaranteed that closing element 14 interrupts the fluidic connection between inlet opening 18 and pouring outlet 12 each time closing element 14 is arranged in the active position independently of whether closing element 14 may be distorted (meaning that the contact portion deviates from initial contact portion 30). Therefore, it is guaranteed that independently of the orientation of package 1 no pourable product enters main space 37 with lid 5 being in the closing configuration and with closing element 14 being in the active position.

Furthermore, by auxiliary space 38 having a frustoconical shape and tapering towards inlet opening 18 the sealing effect is further improved if sections of peripheral portion 28 are deflected towards inlet opening 18.

Additionally, having a contact ring 49 and/or an annular lip 46 and/or a restricting ring 50 allows to improve the overall sealing effect of closing element 14 independently of the exact position of closing element 14.

Clearly, changes may be made to spout 4, spout 4', spout 4", spout 4'", spout 4"" and/or lid-spout assembly 3 and/or package 1 as described herein without, however, departing from the scope of protection as defined in the accompanying claims.

According to an alternative embodiment not shown, control of lid 5 between the closing configuration and the open configuration and accordingly of closing element 14 between the active position and the inactive position is achieved by means of a screwing action on lid 5.

According to an alternative embodiment not shown, spout 4 or spout 4' or spout 4" or spout 4'" could comprise contact ring 49.

According to an alternative embodiment not shown, spout 4' or spout 4" or spout 4"" could comprise restriction ring 50.

The invention claimed is:

1. Spout for a package having a designated pour opening and being filled with a pourable product; the spout comprises at least a collar extending along a longitudinal axis, carrying a pouring outlet at a first axial end and an inlet opening for the pourable product at a second axial end and delimiting a flow channel for the pourable product extending between the pouring outlet and the inlet opening; and a closing element arranged or being arrangeable within the flow channel and being controllable between an active position in which the closing element is configured to interrupt a fluidic connection between the pouring outlet and the inlet opening and an inactive position in which the closing element is configured to allow for a fluidic connection between the pouring outlet and the inlet opening;

wherein the collar comprises an inner surface delimiting the flow channel;

wherein the closing element comprises a peripheral portion being fixed, prior to a first control of the closing element from the active position to the inactive position, to the inner surface along an initial contact portion of the inner surface;

wherein the peripheral portion further comprises a coupling membrane fixing the closing element to the inner surface prior to the first control of the closing element from the active position to the inactive position;

wherein the coupling membrane is configured to irreversibly rupture during the first control of the closing element from the active position to the inactive position;

wherein the inner surface comprises:

a main surface portion extending from the initial contact portion towards the pouring outlet; and an auxiliary surface portion extending from the initial contact portion to the inlet opening, wherein the auxiliary surface portion delimits an auxiliary space having a frustoconical shape and is configured to, after irreversible rupture of the coupling membrane and return of the closing element to the active position, seal with the peripheral portion where the auxiliary surface portion tapers toward the inlet opening, whereby a diameter of the auxiliary surface portion is less than a diameter of the peripheral portion.

2. Spout according to claim 1, wherein the initial contact portion is axially displaced from the inlet opening and towards the pouring outlet.

3. Spout according to claim 1, wherein the initial contact portion is annularly shaped.

4. Spout according to claim 1, wherein the spout is configured such that the auxiliary surface portion is at least partially positioned within an inner space of the package or outside of the inner space.

5. Spout according to claim 1, wherein the collar comprises a main portion having the main surface portion and an auxiliary portion having the auxiliary surface portion.

6. Spout according to claim 5, wherein the spout is configured such that the auxiliary portion protrudes into and inner space of the package and such that the main portion extends away from the inner space or the auxiliary portion comprises an annular lip or a restriction ring.

7. Spout according to claim 1, wherein the pouring outlet extends within a first plane, the inlet opening extends within a second plane distinct from the first plane and the initial contact portion extends within a third plane distinct from the first plane and the second plane; wherein the third plane is interposed between the first plane and the second plane.

8. Lid-spout assembly for a package having a designated pour opening and being filled with a pourable product; the lid-spout assembly comprising a spout according to claim 1 and a lid controllable between at least a closing configuration in which the lid covers the pouring outlet and an open configuration in which the lid is detached from the pouring outlet;

wherein the lid and the closing element are coupled such that the closing element is in the active position and in the inactive position with the lid being respectively in the closing configuration and in the open configuration.

9. Lid-spout assembly for a package having a designated pour opening and being filled with a pourable product, the lid-spout assembly comprising:

a spout that comprises at least a collar extending along a longitudinal axis, carrying a pouring outlet at a first axial end and an inlet opening for the pourable product at a second axial end and delimiting a flow channel for the pourable product extending between the pouring outlet and the inlet opening; and a closing element arranged or being arrangeable within the flow channel and being controllable between an active position in which the closing element is configured to interrupt a fluidic connection between the pouring outlet and the inlet opening and an inactive position in which the closing element is configured to allow for a fluidic connection between the pouring outlet and the inlet opening;

wherein the collar comprises an inner surface delimiting the flow channel;

wherein the closing element comprises a peripheral portion being fixed, prior to a first control of the closing element from the active position to the inactive position, to the inner surface along an initial contact portion of the inner surface;

wherein the inner surface comprises:

a main surface portion extending from the initial contact portion towards the pouring outlet; and an auxiliary surface portion extending from the initial contact portion to the inlet opening, wherein the auxiliary surface portion delimits an auxiliary space having a frustoconical shape and tapers towards the inlet opening, and is configured to seal with the peripheral portion, whereby a diameter of the auxiliary surface portion is less than a diameter of the peripheral portion;

wherein the peripheral portion further comprises a coupling membrane fixing the closing element to the inner surface prior to the first control of the closing element from the active position to the inactive position;

wherein the coupling membrane is configured to irreversibly rupture during the first control of the closing element from the active position to the inactive position, and a lid controllable between at least a closing configuration in which the lid covers the pouring outlet and an open configuration in which the lid is detached from the pouring outlet;

wherein the lid and the closing element are coupled such that the closing element is in the active position and in the inactive position with the lid being respectively in the closing configuration and in the open configuration, wherein the spout comprises a coupling member connected to lid and closing member and configured to operatively couple the closing member to the lid.

10. Lid-spout assembly according to claim 8, and further comprising a coupling ring coupled to the spout;

wherein the lid is hinged to the coupling ring;

wherein the lid is angularly movable around a respective hinge axis so as to control the lid between the closing configuration and the open configuration.

11. Package filled with a pourable product and comprising at least one spout according to claim 1.

12. Package according to claim 11, wherein the package further comprises a main body having the designated pour opening and being formed from a multilayer composite packaging material.

* * * * *